US007090021B2

(12) United States Patent
Pietras

(10) Patent No.: US 7,090,021 B2
(45) Date of Patent: Aug. 15, 2006

(54) APPARATUS FOR CONNECTING TUBLARS USING A TOP DRIVE

(76) Inventor: Bernd-Georg Pietras, Sandriedeweg 12, D-30900 Wedemark (DE)

( * ) Notice: Subject to any disclaimer, the term of this patent is extended or adjusted under 35 U.S.C. 154(b) by 0 days.

(21) Appl. No.: 10/801,289

(22) Filed: Mar. 16, 2004

(65) Prior Publication Data

US 2004/0173357 A1 Sep. 9, 2004

Related U.S. Application Data

(63) Continuation of application No. 09/762,606, filed as application No. PCT/GB99/02708 on Aug. 16, 1999, now Pat. No. 6,705,405.

(30) Foreign Application Priority Data

Aug. 24, 1998 (GB) ..... 9818360.1

(51) Int. Cl.
*E21B 23/00* (2006.01)

(52) U.S. Cl. ..... 166/380; 166/85.1; 166/85.5; 166/77.51

(58) Field of Classification Search ..... 166/85.5, 166/77.51, 85.1, 380; 175/203, 85
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |

(Continued)

FOREIGN PATENT DOCUMENTS

CA 2 335 192 11/2001

(Continued)

OTHER PUBLICATIONS

Lafleur Petroleum Services, Inc., "Autoseal Circulating Head," Engineering Manufacturing, 1992, 11 Pages.

(Continued)

*Primary Examiner*—David Bagnell
*Assistant Examiner*—Giovanna M Collins
(74) *Attorney, Agent, or Firm*—Patterson & Sheridan, LLP

(57) ABSTRACT

An apparatus for facilitating the connection of tubulars using a top drive, said apparatus comprising a motor (4, 4') for rotating a tool (30) for drivingly engaging a tubular, and means (3) for connecting said motor (4, 4') to said top drive, the apparatus being such that, in use, said motor (4, 4') can rotate one tubular with respect to another to connect said tubular.

14 Claims, 2 Drawing Sheets

U.S. PATENT DOCUMENTS

| | | | |
|---|---|---|---|
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchinson |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,320 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |
| 4,194,383 | A | 3/1980 | Huzyak |
| 4,221,269 | A | 9/1980 | Hudson |
| 4,227,197 | A | 10/1980 | Nimmo et al. |
| 4,241,878 | A | 12/1980 | Underwood |
| 4,257,442 | A | 3/1981 | Claycomb |
| 4,262,693 | A | 4/1981 | Giebeler |
| 4,266,444 | A | 5/1981 | Anderson et al. |
| 4,274,777 | A | 6/1981 | Scaggs |
| 4,274,778 | A | 6/1981 | Putnam et al. |
| 4,277,197 | A | 7/1981 | Bingham |
| 4,280,380 | A | 7/1981 | Eshghy |
| 4,281,722 | A | 8/1981 | Tucker et al. |
| 4,287,949 | A | 9/1981 | Lindsey, Jr. |
| 4,311,195 | A | 1/1982 | Mullins, II |
| 4,315,553 | A | 2/1982 | Stallings |
| 4,320,915 | A | 3/1982 | Abbott et al. |
| 4,336,415 | A | 6/1982 | Walling |
| 4,384,627 | A | 5/1983 | Ramirez-Jauregui |
| 4,392,534 | A | 7/1983 | Miida |
| 4,396,076 | A | 8/1983 | Inoue |
| 4,396,077 | A | 8/1983 | Radtke |
| 4,407,378 | A | 10/1983 | Thomas |

4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,733,991 A * 3/1988 Myers ..... 405/224.2
4,735,270 A 4/1988 Fenyvesi
4,738,145 A 4/1988 Vincent et al.
4,742,876 A 5/1988 Barthelemy et al.
4,744,426 A 5/1988 Reed
4,754,807 A 7/1988 Lange
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A * 3/1989 Shaw et al. ..... 173/164
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky 5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,546,317 A 8/1996 Andrieu
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.

6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,776,233 B1 8/2004 Meehan
6,832,656 B1 12/2004 Fournier, Jr. et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway
6,868,906 B1 3/2005 Vail, III et al.
6,877,553 B1 4/2005 Cameron
6,892,835 B1 5/2005 Shahin et al.
6,896,075 B1 5/2005 Haugen et al.
6,899,186 B1 5/2005 Galloway et al.
6,899,772 B1 5/2005 Morando
2001/0042625 A1 11/2001 Appleton
2002/0040787 A1 4/2002 Cook et al.
2002/0066556 A1 6/2002 Goode et al.
2002/0108748 A1 8/2002 Keyes
2002/0134555 A1 9/2002 Allen et al.
2002/0170720 A1 11/2002 Haugen
2002/0189863 A1 12/2002 Wardley
2003/0029641 A1 2/2003 Meehan
2003/0056991 A1 3/2003 Hahn et al.
2003/0070841 A1 4/2003 Merecka et al.
2003/0111267 A1 6/2003 Pia
2003/0141111 A1 7/2003 Pia
2003/0146023 A1 8/2003 Pia
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0217865 A1 11/2003 Simpson et al.
2003/0221519 A1 12/2003 Haugen et al.
2004/0003490 A1 1/2004 Shahin et al.
2004/0003944 A1 1/2004 Vincent et al.

| | | | |
|---|---|---|---|
| 2004/0011534 | A1 | 1/2004 | Simonds et al. |
| 2004/0060697 | A1 | 4/2004 | Tilton et al. |
| 2004/0069500 | A1 | 4/2004 | Haugen |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |

FOREIGN PATENT DOCUMENTS

| | | | |
|---|---|---|---|
| DE | 3 213 464 | | 10/1983 |
| DE | 3 523 221 | | 2/1987 |
| DE | 3 918 132 | | 12/1989 |
| DE | 4 133 802 | | 10/1992 |
| EP | 0 087 373 | | 8/1983 |
| EP | 01 62000 | A1 | 11/1985 |
| EP | 0 171 144 | | 2/1986 |
| EP | 01 171 144 | A1 | 2/1986 |
| EP | 0 235 105 | | 9/1987 |
| EP | 0 265 344 | | 4/1988 |
| EP | 0 285 386 | A2 | 10/1988 |
| EP | 0 426 123 | | 5/1991 |
| EP | 0 462 618 | | 12/1991 |
| EP | 0 474 481 | | 3/1992 |
| EP | 0479583 | | 4/1992 |
| EP | 0 525 247 | A1 | 2/1993 |
| EP | 0 554 568 | | 8/1993 |
| EP | 0 589 823 | A1 | 3/1994 |
| EP | 0 659 975 | | 6/1995 |
| EP | 0 790 386 | | 8/1997 |
| EP | 0 881 354 | | 4/1998 |
| EP | 0 571 045 | | 8/1998 |
| EP | 0 961 007 | | 12/1999 |
| EP | 0 962 384 | | 12/1999 |
| EP | 1 006 260 | | 6/2000 |
| EP | 1 050 661 | | 11/2000 |
| EP | 1148206 | | 10/2001 |
| EP | 1 256 691 | | 11/2002 |
| FR | 2053088 | | 7/1970 |
| FR | 2741907 | | 6/1997 |
| FR | 2 841 293 | | 12/2003 |
| GB | 540 027 | | 10/1941 |
| GB | 709 365 | | 5/1954 |
| GB | 716 761 | | 10/1954 |
| GB | 7 928 86 | | 4/1958 |
| GB | 8 388 33 | | 6/1960 |
| GB | 881 358 | | 11/1961 |
| GB | 9 977 21 | | 7/1965 |
| GB | 1 277 461 | | 6/1972 |
| GB | 1 306 568 | | 3/1973 |
| GB | 1 448 304 | | 9/1976 |
| GB | 1 469 661 | | 4/1977 |
| GB | 1 582 392 | | 1/1981 |
| GB | 2 053 088 | | 2/1981 |
| GB | 2 115 940 | | 9/1983 |
| GB | 2 170 528 | | 8/1986 |
| GB | 2 201 912 | | 9/1988 |
| GB | 2 216 926 | | 10/1989 |
| GB | 2 223 253 | | 4/1990 |
| GB | 2 224 481 | A | 9/1990 |
| GB | 2 240 799 | | 8/1991 |
| GB | 2 275 486 | A | 4/1993 |
| GB | 2 294 715 | | 8/1996 |
| GB | 2 313 860 | | 2/1997 |
| GB | 2 320 270 | | 6/1998 |
| GB | 2 324 108 | | 10/1998 |
| GB | 2 333 542 | | 7/1999 |
| GB | 2 335 217 | | 9/1999 |
| GB | 2 345 074 | | 6/2000 |
| GB | 2 347 445 | | 9/2000 |
| GB | 2 348 223 | | 9/2000 |
| GB | 2 349 401 | | 11/2000 |
| GB | 2 350 137 | | 11/2000 |
| GB | 2 357 101 | | 6/2001 |
| GB | 2 357 530 | A | 6/2001 |
| GB | 2 352 747 | | 7/2001 |
| GB | 2 365 463 | | 2/2002 |
| GB | 2 372 271 | | 8/2002 |
| GB | 2 372 765 | | 9/2002 |
| GB | 2 381 809 | | 5/2003 |
| GB | 2 382 361 | | 5/2003 |
| GB | 2 386 626 | | 9/2003 |
| GB | 2 389 130 | | 12/2003 |
| WO | WO 90-06418 | | 6/1990 |
| WO | WO 91-16520 | | 10/1991 |
| WO | WO 92-01139 | | 1/1992 |
| WO | WO 92-18743 | | 10/1992 |
| WO | WO 92-20899 | | 11/1992 |
| WO | WO 93/07358 | | 4/1993 |
| WO | WO 93-24728 | | 12/1993 |
| WO | WO 95-10686 | | 4/1995 |
| WO | WO 96/18799 | | 6/1996 |
| WO | WO 96-28635 | | 9/1996 |
| WO | WO 97-05360 | | 2/1997 |
| WO | WO 97-08418 | | 3/1997 |
| WO | 97/17524 | | 5/1997 |
| WO | WO 98/01651 | | 1/1998 |
| WO | WO 98/05844 | | 2/1998 |
| WO | WO 98-09053 | | 3/1998 |
| WO | WO 98/11322 | | 3/1998 |
| WO | 98/22690 | | 5/1998 |
| WO | 98/32948 | | 7/1998 |
| WO | WO 98-55730 | | 12/1998 |
| WO | WO 99-04135 | | 1/1999 |
| WO | WO 99-11902 | | 3/1999 |
| WO | WO 99-23354 | | 5/1999 |
| WO | WO 99-24689 | | 5/1999 |
| WO | WO 99-35368 | | 7/1999 |
| WO | WO 99-37881 | | 7/1999 |
| WO | WO 99-41485 | | 8/1999 |
| WO | WO 99-50528 | | 10/1999 |
| WO | WO 99-58810 | | 11/1999 |
| WO | WO 99-64713 | | 12/1999 |
| WO | WO 00/04269 | | 1/2000 |
| WO | WO 00-08293 | | 2/2000 |
| WO | WO 00/09853 | | 2/2000 |
| WO | WO 00/05483 | | 3/2000 |
| WO | WO 00/11309 | | 3/2000 |
| WO | WO 00/11310 | | 3/2000 |
| WO | WO 00/11311 | | 3/2000 |
| WO | WO 00-28188 | | 5/2000 |
| WO | WO 00-37766 | | 6/2000 |
| WO | WO 00-37771 | | 6/2000 |
| WO | WO 00/39429 | | 7/2000 |

| | | |
|---|---|---|
| WO | WO 00/39430 | 7/2000 |
| WO | WO 00/41487 | 7/2000 |
| WO | WO 00-46484 | 8/2000 |
| WO | WO 00-50730 | 8/2000 |
| WO | WO 00-66879 | 11/2000 |
| WO | WO 01-12946 | 2/2001 |
| WO | WO 01-46550 | 6/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |

OTHER PUBLICATIONS

Valves Wellhead Equipment Safety Systems, W-K-M Division, ACF Industries, Catalog 80, 1980, 5 Pages.
"Canrig Top Drive Drilling Systems," Harts Petroleum Engineer International, Feb. 1997, 2 Pages.
"The Original Portable Top Drive Drilling System," TESCO Drilling Technology, 1997, 1page.
Killalea, Mike, "Portable Top Drives: What's Driving The Market?" IADC, Drilling Contractor, Sep. 1994, 4 Pages.
"500 or 650 ECIS Top Drive," Advanced Permanent Magnet Motor Technology, TESCO Drilling Technology, Apr. 1998, 2 Pages.
"500 or 650 HCIS Top Drive," Powerful Hydraulic Compact Top Drive Drilling System, TESCO Drilling Technology, Apr. 1998, 2 Pages.
"Product Information (Sections 1-10)," CANRIG Drilling Technology, Ltd. Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
U.S. Appl. No. 10/189,570, filed Jun. 6, 2002.
U.S. Appl. No. 10/618,093, filed Jul. 11, 1993.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" World Oil, Feb. 1999, pp. 25.
Dean E. Gaddy, Editor, "Russia Shares Technical Know-How with U.S." Oil & Gas Journal, Mar. 1999, pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions,"SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.

* cited by examiner

APPARATUS FOR CONNECTING TUBLARS USING A TOP DRIVE

CROSS-REFERENCE TO RELATED APPLICATIONS

This application is a continuation of U.S. patent application Ser. No. 09/762,606, filed May 21, 2001, now U.S. Pat. No. 6,705,405 which is the National Stage of International Application No. PCT/GB99/02708, filed Aug. 16, 1999, which claims benefit of Great Britain Patent Application No. GB9818360.1, filed Aug. 24, 1988. Each of the aforementioned related patent applications is herein incorporated by reference.

BACKGROUND OF THE INVENTION

FIELD OF THE INVENTION

This invention relates to an apparatus for facilitating the connection of tubulars using a top drive and is more particularly, but not exclusively, intended for facilitating the connection of a section or stand of casing to a string of casing.

SUMMARY OF THE INVENTION

In the construction of oil or gas wells it is usually necessary to line the borehole with a string of tubulars known as a casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation there between. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on a platform, either on rails, or hung from a derrick on a chain. However, it has recently been proposed to use a top drive for making such connection. The normal use of such a top drive maybe the driving of a drill string.

A problem associated with using a top drive for rotating tubulars in order to obtain a connection between tubulars is that some top drives are not specifically designed for rotating tubulars are not able to rotate at the correct speed or have non standard rotors.

According to the present invention there is provided an apparatus for facilitating the connection of tubulars using a top drive, said apparatus comprising a motor for rotating a tool for drivingly engaging a tubular, and means for connecting said motor to said top drive, the apparatus being such that, in use, said motor can rotate one tubular with respect to another to connect said tubulars.

Other features of the invention are set out in claims 2 et seq.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION OF THE PREFERRED EMBODIMENT

Figure 1:
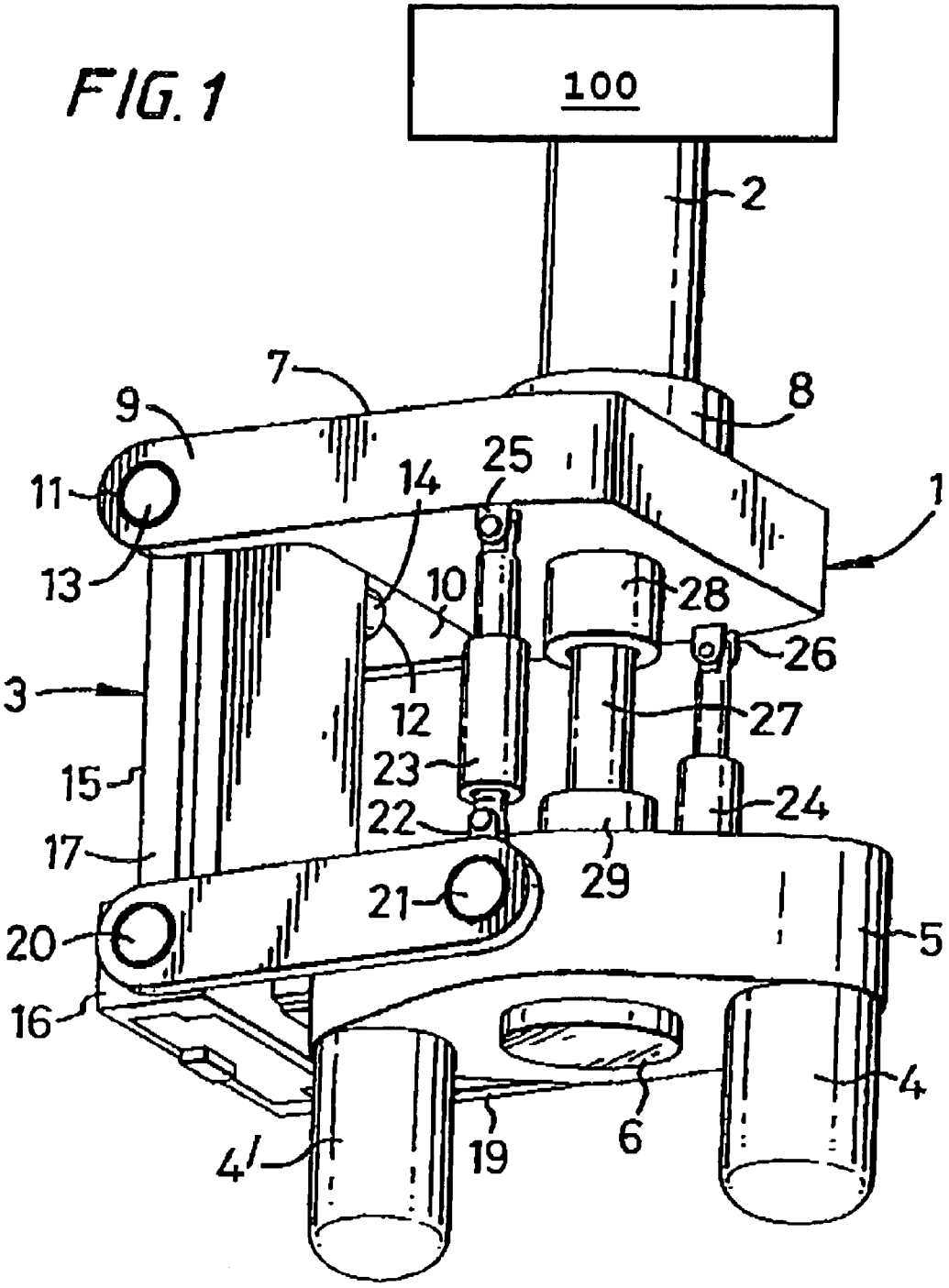
FIG. 1 is a front perspective view of an apparatus in accordance with the present invention.

Referring to FIG. 1 there is shown an apparatus which is generally identified by reference numeral 1.

The apparatus 1 comprises a connecting tubular 2, a suspension unit 3 and a hydraulic motor 4 and 4'. The hydraulic motor 4,4' has a stator 5 and a rotor 6 and is driven by a supply of pressurised hydraulic fluid (the fluid supply lines are not illustrated in the Figures). The suspension unit 3 suspends the hydraulic motor 4,4' from the connecting tubular 2.

The suspension unit 3 comprises a plate 7 which is fixed to the connecting tubular 2 by a collar 8. The plate 7 has two projections 9 and 10 which have holes 11 and 12 for accommodating axles 13 and 14, which arc rotationally disposed therein. The axles 13 and 14 are integral with a rigid body 15. A slider 16 is arranged on runners 17 and (not shown) on the rigid body 15. Arms 18 and 19 are connected at one end to the slider 16 via spherical bearings 20 and at the other end to each side of the stator 5 via spherical bearings 21 and 21'. The arms 18 and 19 are provided with lugs 22 and 22' to which one end of a piston and cylinder 23, 24 is attached and are movable thereabout. The other end of each piston and cylinder 23, 24 is attached to lugs 25, 26 respectively and is movable thereabout. A mud pipe 27 is provided between the plate 7 and the stator 5 for carrying mud to the inside of a tubular therebelow. The mud pipe 27 comprises curved outer surfaces at both ends (not shown) which are located in corresponding recesses in cylindrical sections 28, 29, thus allowing a ball and socket type movement between the plate 7 and the stator 5.

Figure 2:
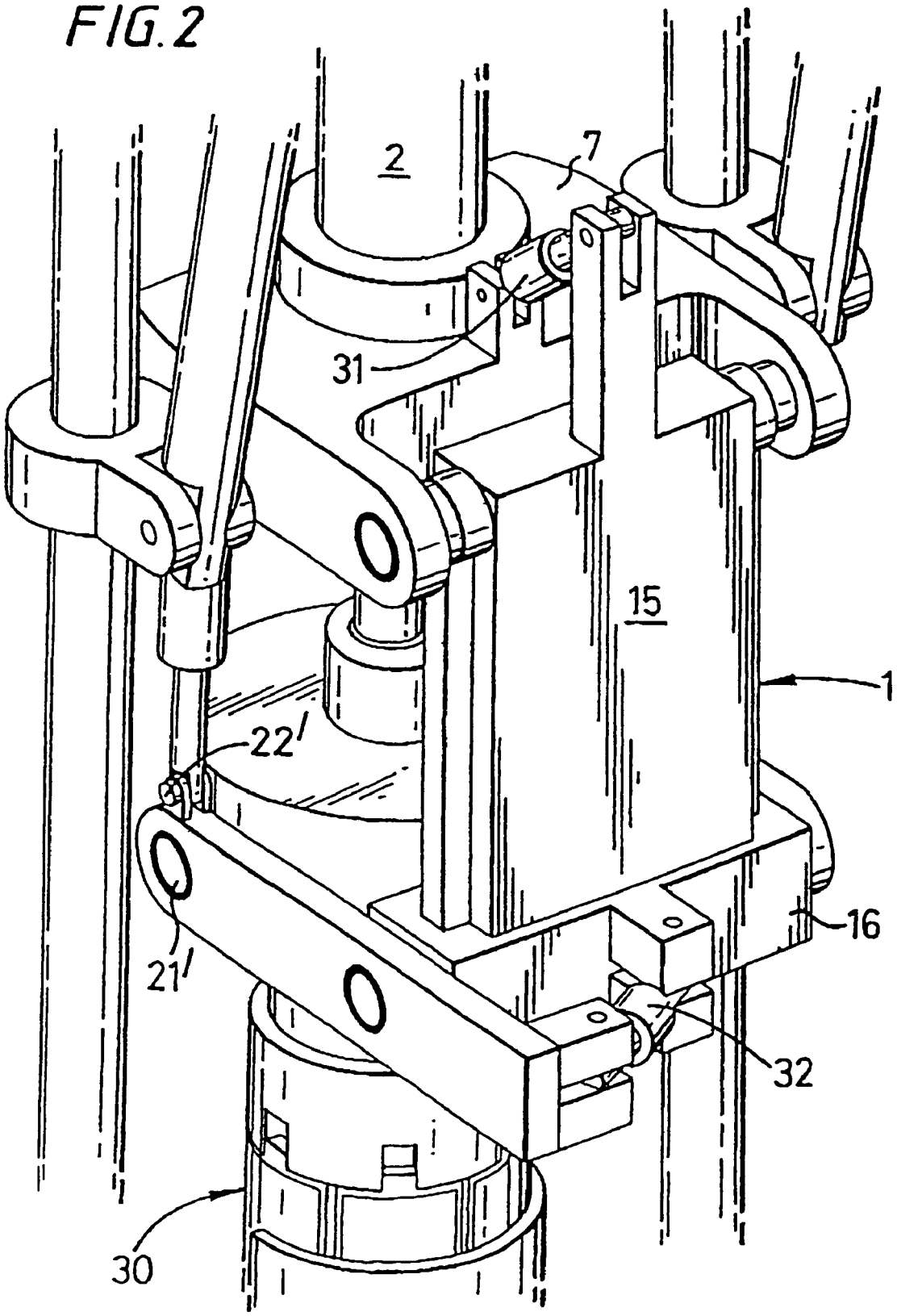
FIG. 2 is a rear perspective view of the apparatus of FIG. 1 in use.

Referring to FIGS. 1 and 2, the apparatus 1 is suspended from a top drive 110 via connecting shaft 2. A tool 30 for engaging with a tubular is suspended from beneath the rotor 6 of the hydraulic motor 4. Such a tool may be arranged to be inserted into the upper end of the tubular, with gripping elements of the tool being radially displaceable for engagement with the inner wall of the tubular so as to secure the tubular to the tool.

In use, a tubular (not shown) to be connected to a tubular string held in a spider (not shown) is located over the tool 30. The tool 30 grips the tubular. The apparatus 1 and the tubular are lowered by moving the top drive so that the tubular is in close proximity with the tubular string held in the spider. However, due to amongst other things manufacturing tolerances in the tubulars, the tubular often does not align perfectly with the tubular held in the spider. The suspension unit 3 allows minor vertical and horizontal movements to be made by using alignment pistons 31 and 32 for horizontal movements, and piston and cylinders 23 and 24 for vertical movements. The alignment piston 31 acts between the rigid body 15 and the plate 7. The alignment piston 32 acts between the slider 16 and the arm 19. The alignment pistons 31 and 32 and pistons and cylinders 23, 25 are actuated by hydraulic or pneumatic means and controlled from a remote control device.

The piston and cylinders 23, 24 are hydraulically operable. It is envisaged however, that the piston and cylinders 23, 24 may be of the pneumatic compensating type, i.e. their internal pressure may be adjusted to compensate for the weight of the tubular so that movement of the tubular may be conducted with minimal force. This can conveniently be achieved by introducing pneumatic fluid into the piston and cylinder 23, 24 and adjusting the pressure therein.

Once the tubulars are aligned, the hydraulic motor 4 and 4' rotate the tubular via 15 gearing in the stator 5 thereby making up the severed connection. During connection the compensating piston and cylinders 23, 24 expand to accommodate the movement of the upper tubular. The alignment pistons 31 and 32 can then be used to move the top of the tubular into alignment with the top drive. If necessary, final torquing can be conducted by the top drive at this stage, via rotation of the pipe 27, and the main elevator can also be swung onto and connected to the tubular prior to releasing the slips in the spider and lowering the casing string. It will be appreciated that the suspension unit 3 effectively provides an adapter for connecting a top drive to the tubular engaging tool 30.

The invention claimed is:

1. A method of facilitating making of a connection between an upper tubular and a lower tubular, comprising:
- engaging the upper tubular with a tubular engagement tool of a top drive having a suspension unit;
- engaging a lower end of the upper tubular with an upper end of the lower tubular;
- rotating the upper tubular via the tubular engagement tool, thereby threading the tubulars to form the connection;
- torquing the connection via the tubular engagement tool; and
- compensating for movement of the upper tubular with the suspension unit during the threading.

2. The method of claim 1, further comprising adjusting the suspension unit to move the upper tubular in at least two planes.

3. The method of claim 1, wherein compensating for movement of the upper tubular comprises pneumatically compensating via at least one piston and cylinder arrangement.

4. A method of facilitating making of a connection between an upper tubular and a lower tubular, comprising:
- engaging the upper tubular with gripping assembly having at least one radially displaceable element for gripping the upper tubular, wherein the gripping assembly is connected to a top drive having a suspension unit;
- compensating for weight of the upper tubular to accommodate movement of the upper tubular while engaged by the gripping assembly;
- engaging a lower end of the upper tubular with an upper end of the lower tubular to form the connection therebetween; and
- delivering torque to the upper tubular via the gripping assembly.

5. The method of claim 4, wherein engaging the lower end of the upper tubular with the upper end of the lower tubular includes rotating the upper tubular, thereby threading the tubulars together.

6. The method of claim 4, further comprising compensating for movement of the upper tubular with the suspension unit during the threading.

7. The method of claim 4, further comprising adjusting the suspension unit to move the upper tubular in at least two planes.

8. The method of claim 4, wherein compensating for weight of the upper tubular comprises compensating via at least one piston and cylinder arrangement.

9. The method of claim 4, wherein compensating for weight of the upper tubular is pneumatic.

10. A method of facilitating making of a connection between an upper tubular and a lower tubular, comprising:
- providing a make-up unit having a top drive, a suspension unit and a tubular engagement tool;
- engaging the upper tubular with the tubular engagement tool;
- engaging a lower end of the upper tubular with an upper end of the lower tubular;
- rotating the upper tubular with the top drive via the tubular engagement tool, thereby threading the tubulars to form the connection;
- torquing the connection with the top drive via the tubular engagement tool; and
- compensating for movement of the upper tubular with the suspension unit during the threading.

11. The method of claim 10, further comprising adjusting the suspension unit to move the upper tubular in at least two planes.

12. The method of claim 10, wherein compensating for movement of the upper tubular comprises pneumatically compensating via at least one piston and cylinder arrangement.

13. The method of claim 10, wherein compensating for movement of the upper tubular comprises compensating via at least one piston and cylinder arrangement.

14. The method of claim 10, wherein the tubular engagement tool includes at least one gripping element displaceable in a radial direction for engagement with a wall of the upper tubular during engaging the upper tubular.

* * * * *